US005794688A

United States Patent [19]

Heering et al.

[11] Patent Number: 5,794,688

[45] Date of Patent: Aug. 18, 1998

[54] HEAT INSULATION AND CORROSION PROTECTION OF THE INNER VESSEL WALL OF A HEAT EXCHANGER

[75] Inventors: Jürgen Heering, Korschenbroich; Klaus Köhnen, Mülheim; Michael Havlik, Krefeld; Hermann Knorth, Hünxe, all of Germany

[73] Assignee: MAN Gutehoffnungshütte Aktiengesellschaft, Oberhausen, Germany

[21] Appl. No.: 713,163

[22] Filed: Sep. 12, 1996

[30] Foreign Application Priority Data

Sep. 13, 1995 [DE] Germany ..... 195 33 902.9

[51] Int. Cl.[6] ..... F28F 13/00

[52] U.S. Cl. ..... 165/134.1; 165/135

[58] Field of Search ..... 165/134.1, 135

[56] References Cited

U.S. PATENT DOCUMENTS

| | | | |
|---|---|---|---|
| 2,057,299 | 10/1936 | Foss | 165/135 |
| 2,215,532 | 9/1940 | Richardson | 165/135 X |
| 2,623,810 | 12/1952 | Kraft et al. | 165/134.1 |
| 3,433,298 | 3/1969 | Vollhardt | 165/134.1 |
| 4,531,511 | 7/1985 | Hochberg | 165/135 X |
| 4,735,260 | 4/1988 | Wohrl et al. | 165/135 X |

FOREIGN PATENT DOCUMENTS

| | | | |
|---|---|---|---|
| 1748 | 1/1977 | Japan | 165/135 |
| 73657 | 6/1978 | Japan | 165/135 |

*Primary Examiner*—Leonard R. Leo
*Attorney, Agent, or Firm*—McGlew and Tuttle

[57] ABSTRACT

A heat insulation and corrosion protection of the inner vessel wall of a heat exchanger in a synthesis gas cooler. The heat insulation and corrosion protection are arranged above a thermal seal fastened between the vessel wall and the cooling tubes. The insulation and protection includes segments of fiber-filled plates, which are fastened to the vessel wall by means of a substructure and an adhesive or foam material. Support rings with a heat insulation protection means absorb the vertical forces. A metallic corrosion protection layer is applied to the inner vessel wall under the thermal seal. Free breathing of the vessel wall is possible and pressure equalization between the gas space and the annular space is guaranteed due to the heat insulation and corrosion protection according to the present invention.

18 Claims, 2 Drawing Sheets

HEAT INSULATION AND CORROSION PROTECTION OF THE INNER VESSEL WALL OF A HEAT EXCHANGER

FIELD OF THE INVENTION

The present invention pertains to a heat insulation and corrosion protection of the inner vessel wall of a heat exchanger with a thermal seal fastened between the cooling tube coil and the vessel wall.

BACKGROUND OF THE INVENTION

The flue gas/synthesis gas flowing through the inner gas space of a heat exchanger has free access at the lowermost end of the boiler tube wall bundle to the annular space formed between the vessel wall or the pressure shell wall and the tube bundle, so that approximately the same pressure occurs in the gas space and the annular space.

The cooling surfaces of the heat exchanger, which are arranged in the synthesis gas cooler, extract part of the sensible heat from the flue gas/synthesis gas, and the solid components are also cooled at the same time and are separated in a water bath.

In a heat exchanger recently delivered by the applicant for a coal-to-gas plant in the U.S.A., the sealing of the annular space against the hot gases and consequently the protection of the inner wall of the heat exchanger are ensured by a gas-sealing system arranged at the lower tube bundle, in which system a double, inner and outer seal with compression screws is arranged between the vessel wall and the lower cooling coils and the tube bundle. A heavy wrapping of the lower part of the tube bundle is required for fastening the gas-sealing system to the inner tube bundle.

For pressure equalization and for protecting the inner vessel wall against corrosion, an inert gas, e.g., nitrogen, is injected into the annular space above the seal; a so-called free breathing of the vessel wall does not take place.

The protection of the inner vessel wall of a synthesis gas cooler or heat exchanger in the area of the annular space by applying a protective layer of refractory concrete has been known as well. However, this layer is characterized by a very high own weight, which is unfavorable for the lining of the pressure shell, claws, steel structures, and foundations, and, from the viewpoint of costs, for carrying out the assembly.

SUMMARY AND OBJECTS OF THE PRESENT INVENTION

The primary object of the present invention is therefore to provide heat insulation and corrosion protection on the inner vessel wall, which offer a similar protection at considerably reduced weight and reduced layer thickness, and which can, in addition, be introduced with ease and can be easily repaired when necessary.

According to the invention, heat insulation and corrosion protection of the inner vessel wall of a heat exchanger is provided with a thermal seal fastened between a cooling tube coil and the vessel wall. Segments of the heat insulation and corrosion protection plates with the circular support rings arranged between them are introduced at the vessel wall above the seal and a topmost tube of the cooling coil. The segments are fastened to the vessel wall by means of a substructure and an adhesive. A wedge-shaped plate part is arranged on an inside of a lowermost segment of the heat insulation and corrosion protection plates above the topmost tube of the cooling coil or a corrosion protection and heat insulation above the seal and the topmost tube of the cooling coil are achieved by means of a heat-resistant foam material applied to the substructure.

The gas flowing through the gas space of the heat exchanger has free access to the annular space, which is formed by the tube bundle and the outer pressure shell of the synthesis gas cooler, so that approximately the same pressure occurs in both spaces.

A wall-side tube coil with a web plate extending into a water bath is arranged in the lower area of the heat exchanger.

A seal, which also forms the foot of the inner wall protection according to the present invention by ceramic fiber-filled plates at the same time, is arranged at the top end of the cooling coil. The wedge-shaped plate part arranged above the topmost cooling tube is designed as a so-called dust slip slope in order to avoid a possible dust build-up in this area.

The heat insulation and corrosion protection layer is composed according to the present invention of a plurality of individual ceramic fiber-filled plates. The fiber-filled plates, which consist of a highly heat-insulating material, are in turn placed on circular rings. These rings absorb the vertical forces which are generated by the own weight of the plates and possible dust deposits on the front side of the plates. The fiber-filled plates are bonded to the inner vessel wall of the pressure shell in the radial direction.

To achieve good anchoring between the fiber-filled plate and the inner vessel wall, a suitable substructure, e.g., expanded metal, honeycomb grid, perforated plate, etc., is applied to the vessel wall in order to impart good anchoring to the adhesive. The support rings are provided with a heat insulation protection means on the front side in order to prevent corrosion at the rings.

Instead of segments of ceramic fiber-filled plates with circular support rings, it is possible to arrange a heat-resistant, ceramic foam material, which is foamed on the substructure as continuous corrosion protection and heat insulation along the inner wall. The support rings may be omitted altogether, or the number of circular support rings may be considerably reduced.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention are illustrated.

DESCRIPTION OF THE PREFERRED EMBODIMENT

Figure 1:
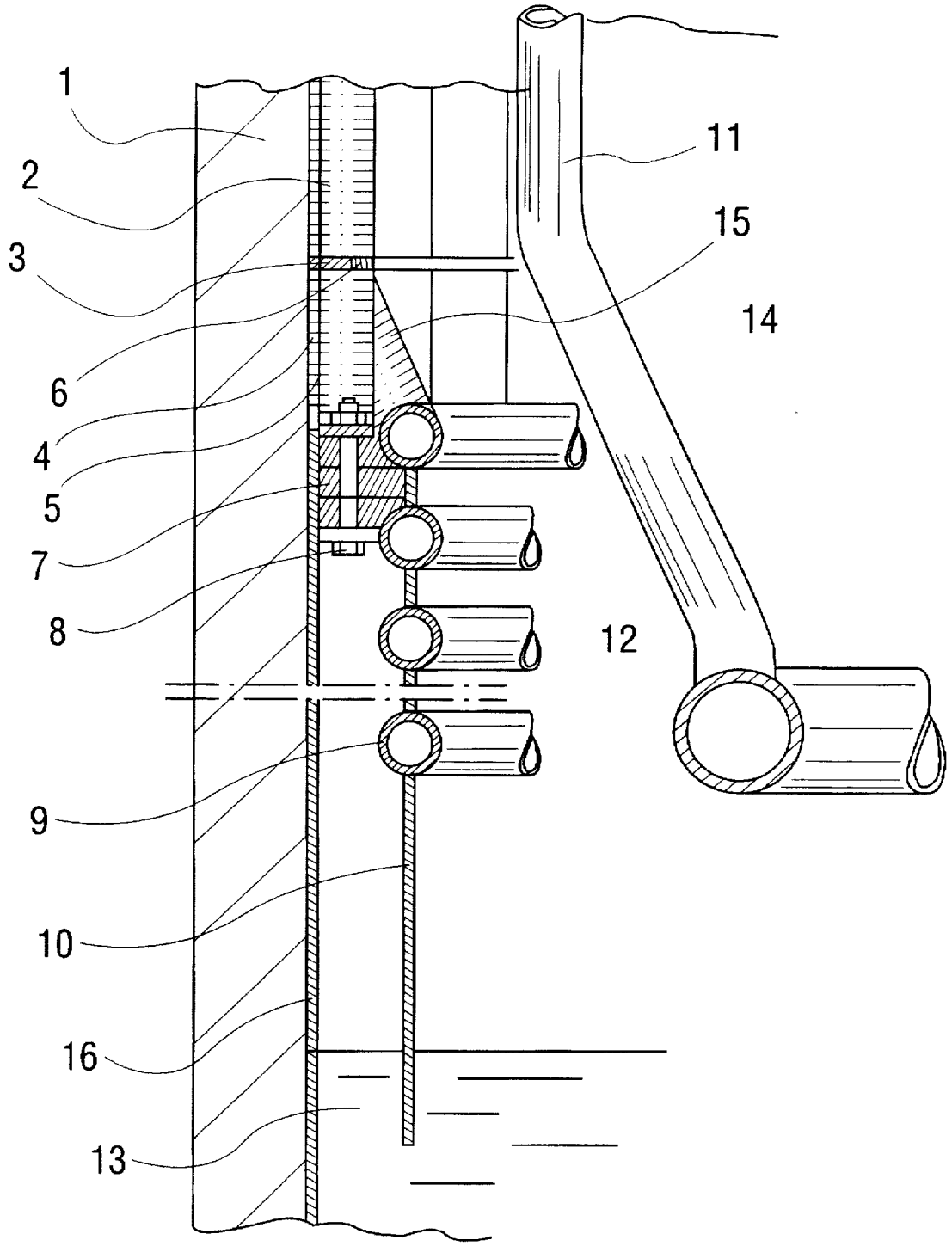
FIG. 1 is a sectional view through the lower area of the synthesis gas cooler.

Referring to the drawings in particular, FIG. 1 shows the lower area of the synthesis gas cooler, in which the gas to be cooled flows downward through the inner gas space 14 formed by a tube bundle 11. An annular space 12 is formed between the vessel wall 1 and the tube bundle 11, so that approximately the same pressure occurs in the gas space 14 and the annular space 12.

A wall-side cooling coil 9 with a web plate 10 extending into a water bath 13 is arranged at the wall area of the tube bundle 11 of the heat exchanger. The inner vessel wall 1 is protected by a corrosion protection layer 16 here. A seal 7, which also forms the foot of the wall protection formed by ceramic fiber-filled plates 2 at the same time, is arranged at the top end of the cooling coil 9.

Continuous heat insulation and corrosion protection of the inner wall 1 of the pressure shell is thus ensured. A metallic corrosion protection means 16 is introduced in the lower area of the heat exchanger at the level of the cooling coils 9 with web plates 10, and a cover with ceramic fiber material 2 is introduced above the cooling coils 9.

The seal 7 comprises, in the known manner, fiber-filled plates which are arranged one on top of another and are mounted on a web plate welded to a cooling tube 9. So-called compression screws 8 with washers, which compress the fiber-filled plates, are introduced through holes in the web plate.

A plate part 15 cut in a wedge-shaped manner has the task of acting as a dust slip slope in order to prevent a possible build-up of dust.

Each segment of the heat insulation and corrosion protection is assembled from a plurality of individual fiber-filled plates 2 and is placed on circular support rings 3. These support rings 3 absorb the vertical forces generated by the own weight of the fiber-filled plates and by possible dust deposits on the front side of the fiber-filled plates 2.

The fiber-filled plates 2 are bonded to the inner wall 1 of the pressure shell in the radial direction. To achieve good bonded anchoring between the fiber-filled plates 2 and the inner wall 1, a suitable substructure 4 is applied to the inner wall 1 in order to ensure corresponding anchoring of the adhesive 5.

The support rings 3 are provided with a heat insulation protection means 6 on the front side in order to prevent corrosion at the support rings 3.

Figure 2:
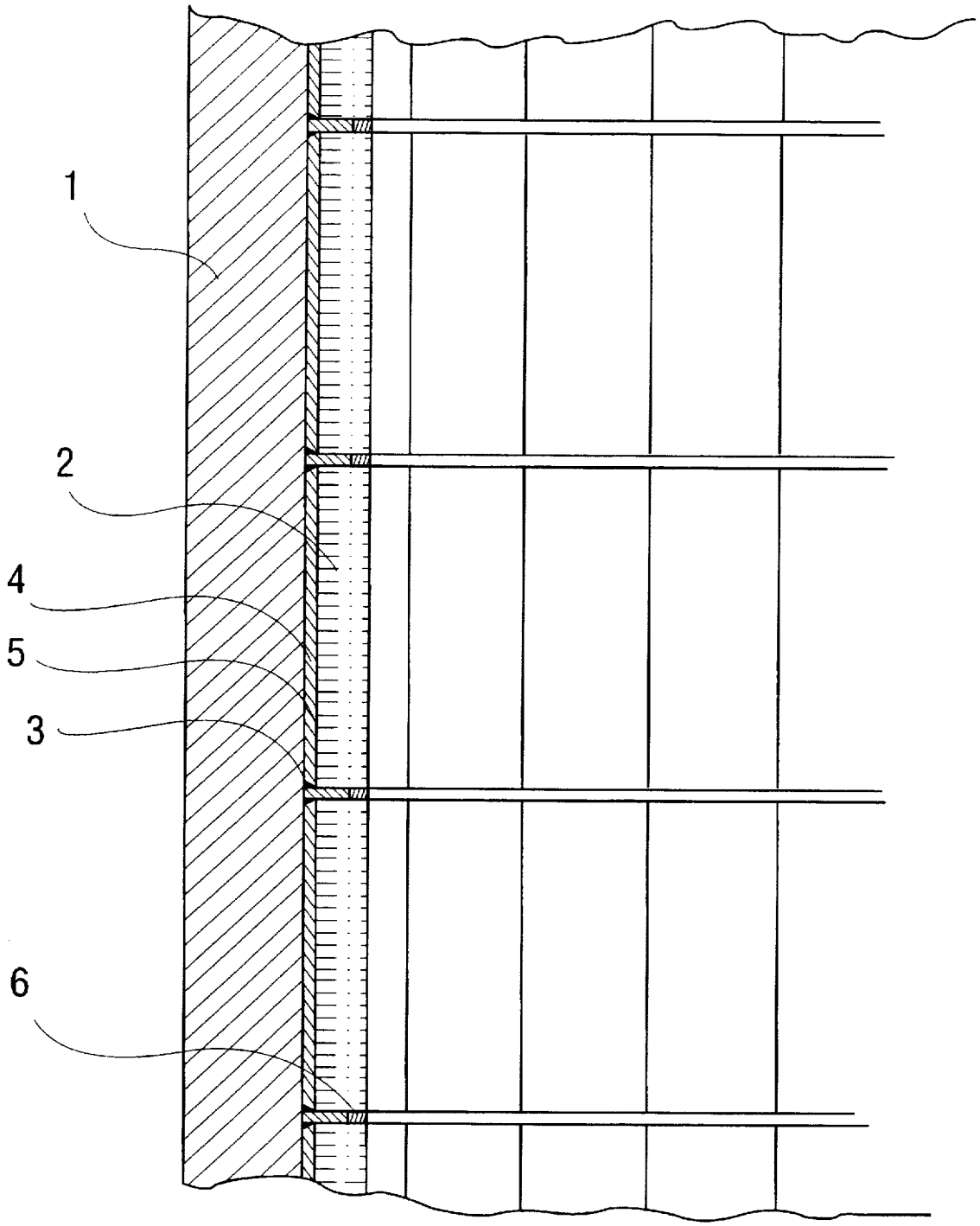
FIG. 2 is a sectional view through the inner wall protected with a protective layer.

FIG. 2 shows a section of the structure of the heat insulation and corrosion protection layer on the inside of the vessel wall 1. Fiber-filled plates 2 divided into segments are arranged above the cooling tube coil, not shown, and the seal, and they are held by support rings 3 provided with corrosion protection 6. In addition, the fiber-filled plates 2 are fastened to the inside of the vessel wall 1 by means of a substructure 4 and an adhesive 5.

Instead of segments of ceramic fiber-filled plates 2 with circular support rings 3, a heat-resistant, ceramic foam material. The foam is preferably a ceramic, heat-insulating fibrous material which is foamed on the substructure as continuous corrosion protection and heat insulation along the inner wall. The support rings 3 may be omitted altogether, or the number of circular support rings 3 may be considerably reduced but provided in contact with the foam for support of the weight of the foam.

While a specific embodiment of the invention has been shown and described in detail to illustrate the application of the principles of the invention, it will be understood that the invention may be embodied otherwise without departing from such principles.

What is claimed is:

1. A method for providing heat insulation and corrosion protection of an inner vessel wall of a heat exchanger, comprising the steps of:

providing a substructure disposed adjacent to the inner vessel wall; and arranging heat insulation and corrosion protection means at the inner vessel wall including one of introducing wall protection plates provided in segments with circular support rings between them and fastening, said segments to said vessel wall and said substructure by adhesive, applying a heat-resistant foam material to said substructure for corrosion protection and heat insulation, and applying a heat-resistant foam material to said substructure for corrosion protection and heat insulation with circular support rings disposed in contact with said heat resistant foam material.

2. A method in accordance with claim 1, wherein a heat insulation protection means is fastened on the inside of the said support rings for heat insulating said support rings.

3. A method in accordance with claim 1, wherein said substructure comprises one of an expanded metal, a honeycomb grid and a perforated plate.

4. A method in accordance with claim 1, wherein a metallic corrosion protection layer is applied to said vessel wall in an area of a water bath in the vessel and up to a level of said substructure.

5. A method in accordance with claim 1, wherein each of said heat insulation and corrosion protection plates comprise a ceramic, heat-insulating fiber filler.

6. A method in accordance with claim 1, wherein said heat insulation and corrosion protection layer applied to the said substructure by foaming consists of a ceramic, heat-insulating fibrous material.

7. A heat insulation and corrosion protection device of an inner vessel wall of a heat exchanger, comprising:

a cooling tube coil;

a thermal seal fastened between said cooling tube coil and the inner vessel wall;

a substructure disposed adjacent to the inner vessel wall;

heat insulation and corrosion protection means disposed at the inner vessel wall above said thermal seal and above a topmost said tube of said cooling tube coil comprising one of wall protection plates provided in segments with circular support rings arranged between them with an adhesive, said segments being fastened to said vessel wall and said substructure by adhesive, a heat-resistant foam material applied to said substructure for corrosion protection and heat insulation, and a heat-resistant foam material applied to said substructure for corrosion protection and heat insulation with circular support rings disposed in contact with said heat resistant foam material; and a wedge-shaped plate part arranged on an inside of a lowermost portion of said heat insulation and corrosion protection means, above said topmost tube of said cooling coil.

8. A device in accordance with claim 7, wherein a heat insulation protection means is fastened on the inside of the said support rings for heat insulating said support rings.

9. A device in accordance with claim 7, wherein said substructure comprises one of an expanded metal, a honeycomb grid and a perforated plate.

10. A device in accordance with claim 7, wherein a metallic corrosion protection layer is applied to said vessel wall in an area of a water bath in the vessel and up to a level of said substructure.

11. A device in accordance with claim 7, wherein each of said heat insulation and corrosion protection plates comprise a ceramic, heat-insulating fiber filler.

12. A device in accordance with claim 7, wherein said heat insulation and corrosion protection layer applied to the said substructure by foaming consists of a ceramic, heat-insulating fibrous material.

13. A heat insulation and corrosion protection device of an inner vessel wall of a heat exchanger, comprising:

a cooling tube coil with a topmost tube;

a thermal seal fastened between said cooling tube coil and the inner vessel wall;

a substructure disposed adjacent to the inner vessel wall; and heat insulation and corrosion protection means disposed at the inner vessel wall above said thermal seal and above said topmost tube of said cooling coil comprising one of wall protection plates provided in segments with circular support rings arranged between them with an adhesive, said segments being fastened to said vessel wall and said substructure by adhesive, a heat-resistant foam material applied to said substructure for corrosion protection and heat insulation, and a heat-resistant foam material applied to said substructure for corrosion protection and heat insulation with circular support rings disposed in contact with said heat resistant foam material.

14. A device in accordance with claim 13, wherein a heat insulation protection means is fastened on the inside of the said support rings for heat insulating said support rings.

15. A device in accordance with claim 13, wherein said substructure comprises one of an expanded metal, a honeycomb grid and a perforated plate.

16. A device in accordance with claim 13, wherein a metallic corrosion protection layer is applied to said vessel wall in an area of a water bath in the vessel and up to a level of said substructure.

17. A device in accordance with claim 13, wherein each of said heat insulation and corrosion protection plates comprise a ceramic, heat-insulating fiber filler.

18. A device in accordance with claim 13, wherein said heat insulation and corrosion protection layer applied to the said substructure by foaming consists of a ceramic, heat-insulating fibrous material.

* * * * *